United States Patent [19]

Okuda et al.

[11] 4,094,174

[45] June 13, 1978

[54] DRIVE MECHANISM FOR VERTICAL ROLLING MILLS

[75] Inventors: Hiroji Okuda, Nara; Hiroyoshi Narikiyo, Yaoshi, both of Japan

[73] Assignee: Koyo Seiko Company Limited, Osaka, Japan

[21] Appl. No.: 818,958

[22] Filed: Jul. 25, 1977

[30] Foreign Application Priority Data

Apr. 5, 1977 Japan ..... 52/39306

[51] Int. Cl.[2] ..... B21B 31/08

[52] U.S. Cl. ..... 72/238; 72/249

[58] Field of Search ..... 72/249, 238, 239; 64/23

[56] References Cited

U.S. PATENT DOCUMENTS 1,891,579 12/1932 Schreck ..... 72/239

2,195,502 4/1940 Smitmans ..... 72/238

*Primary Examiner*—Milton S. Mehr

*Attorney, Agent, or Firm*—Mason, Fenwick & Lawrence

[57] ABSTRACT

A drive mechanism which itself has the function of mounting a driven coupling on and dismounting it from a roll neck. The drive mechanism comprises a drive shaft section comprising inner and outer shafts coupled together in such a manner as to be only axially slidable, an extensible operating mechanism disposed between the inner and outer shafts for extending and collapsing the drive shaft section to mount the coupling on and dismount it from the neck of a working roll, a spring disposed between the inner and outer shafts and acting in a direction in which it reduces the length of the drive shaft section, and fixing device for fixing the drive shaft section to a drive universal joint when the drive shaft section is reduced in length.

4 Claims, 2 Drawing Figures

DRIVE MECHANISM FOR VERTICAL ROLLING MILLS

BACKGROUND OF THE INVENTION

The present invention relates to a drive mechanism for vertical rolling mills and more particularly it relates to a drive mechanism for vertical rolling mills which itself is provided with a device for mounting a driven coupling on and dismounting it from the neck of a working roll.

A conventional vertical rolling mill uses as its drive mechanism a universal spindle such as those shown in FIG. 1. Thus, the torque from a motor 1 is transmitted to working rolls 5 through a speed reducer 2, bevel gear units 3 and universal spindles 4. The universal spindles 4 are connected to the drive and driven sides through upper and lower slipper couplings 6 and 7, respectively. At the time of roll exchange, an unillustrated pin associated with the slipper coupling 7 is removed to remove the slipper, thus cutting the connection between the roll 5 and the spindle 4, and then the shaft portion of the universal spindle 4 is pulled laterally as indicated by an arrow and held in that position, whereupon roll exchange is effected. In the figure, 8 designates a vertical rolling mill stand and 9 designates a roll stand.

In such vertical rolling mill with universal spindles, there has been the drawback that roll exchange involves very troublesome procedures, including removal of the pin and slipper and pulling of the universal spindle shaft portion, and requires much time and labor. Further, the slippers wear in a short time and there are many problems about their material and lubrication. Another drawback is that the wear of such slipper has to be contended with by the troublesome procedure of filling the resulting gap with a shim or shims and that the maintenance thereof is difficult.

On the other hand, as is disclosed in U.S. Pat. No. 3,670,587, there has been proposed a vertical rolling mill designed so that roll exchange is effected by moving two working rolls away from each other and then downwardly and pulling out the roll necks from the couplings of the drive mechanism. In this case, however, an elaborate device is required for sliding said working rolls laterally and moving them axially, and unless the couplings of the drive mechanism are fixed in position after the roll necks are pulled out, the subsequent procedure of inserting fresh roll necks into the couplings becomes very difficult. Therefore, it is necessary to provide a fixing device therefor.

SUMMARY OF THE INVENTION

An object of the present invention is to simplify and compact the construction of a vertical rolling mill by providing the drive mechanism itself with a device for mounting the couplings on and dismounting them from roll necks.

Another object of the invention is to reduce the loads on the bearings supporting the working rolls and prolong the life thereof by providing a spring inside the drive mechanism for assisting in removing said couplings from the roll necks.

A further object of the invention is to accelerate and facilitate roll exchange by fixing the drive shaft section of the drive mechanism to the universal joint connected to the drive side when the coupling is removed from the roll neck.

Still a further object of the invention is to improve the maintenance of a vertical rolling mill by interconnecting a drive shaft element and a working roll, which is a driven shaft element, and using universal joints in the drive mechanism which effect the centering of said shaft elements and the transmission of torque.

The drive mechanism used in the invention incorporates in the drive shaft section an assembly comprising an inner shaft and an outer sleeve shaft which are lengthwise extensibly fitted together, permitting the axial extension and collapsing of the drive shaft section and the transmission of torque.

According to the invention, the operation of mounting and dismounting the coupling for roll exchange is very easy, so that roll exchange can be quickly and easily carried out, thus greately reducing the reparing time and greately improving the rate of operation of the vertical rolling mill and the like.

It is possible to achieve a prolonged continuous maintenance-free rolling operation and the use of universal joints precludes the outflow of grease, making it possible to take measures for the disposal of oil-containing sludge, and the power consumption can be reduced as a result of improved rate of power transmission.

Further, also in the case of an intermediate drive type, it is possible to reduce the vibratory noise level, and since the coupling is always upwardly urged by a spring, the load on the bearing supporting the working roll is reduced to improve the life of the bearing. At the time of roll exchange, the drive shaft section is fixed, preventing the swing of the joint and the coupling, thus facilitating roll exchange. Further, the construction of the drive mechanism is simple and inexpensive.

Other objects and features of the invention will become more apparent from the following description.

DESCRIPTION OF THE PREFERRED EMBODIMENT

Figure 2:
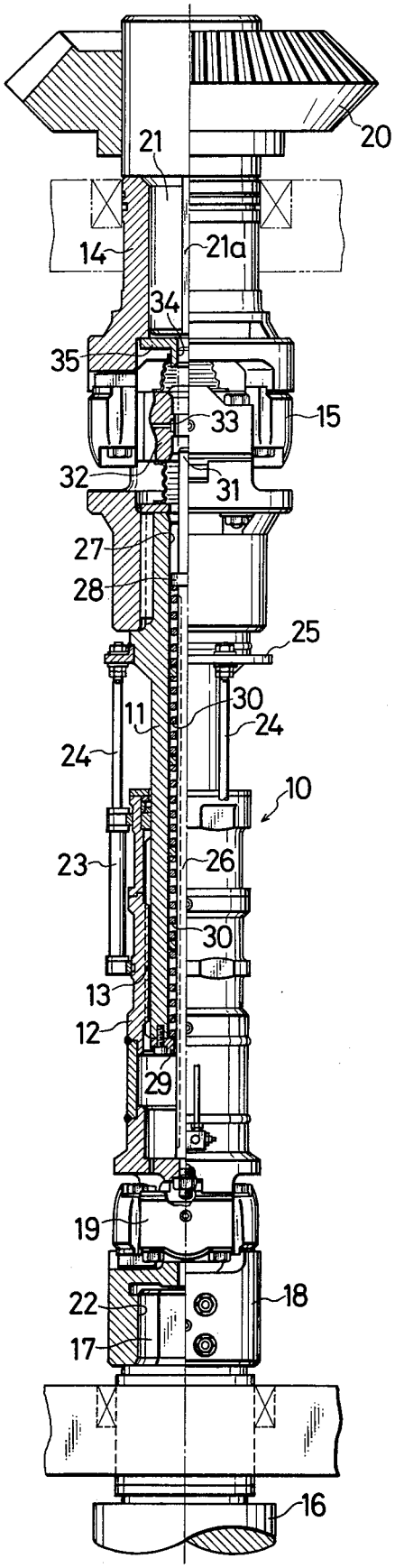
FIG. 2 is a front view, partly in longitudinal section, of an embodiment of the present invention.

Referring to FIG. 2, the drive shaft section 10 of the drive mechanism comprises an inner shaft 11 which is a hollow shaft and an outer sleeve shaft 12 which is also a hollow shaft, said shafts being fitted together as by a spline connection 13 in such a manner as to be only axially slidable relative to each other. The end of the inner shaft 11 is connected to a drive fitting yoke 14 (which forms the yoke of a universal joint 15) through the universal joint 15, while the end of the outer sleeve shaft 12 is connected through a universal joint 19 to a coupling 18 adapted to be mounted on and dismounted from the neck of a working roll 16 and forming the yoke of the universal joint 19.

Figure 1:
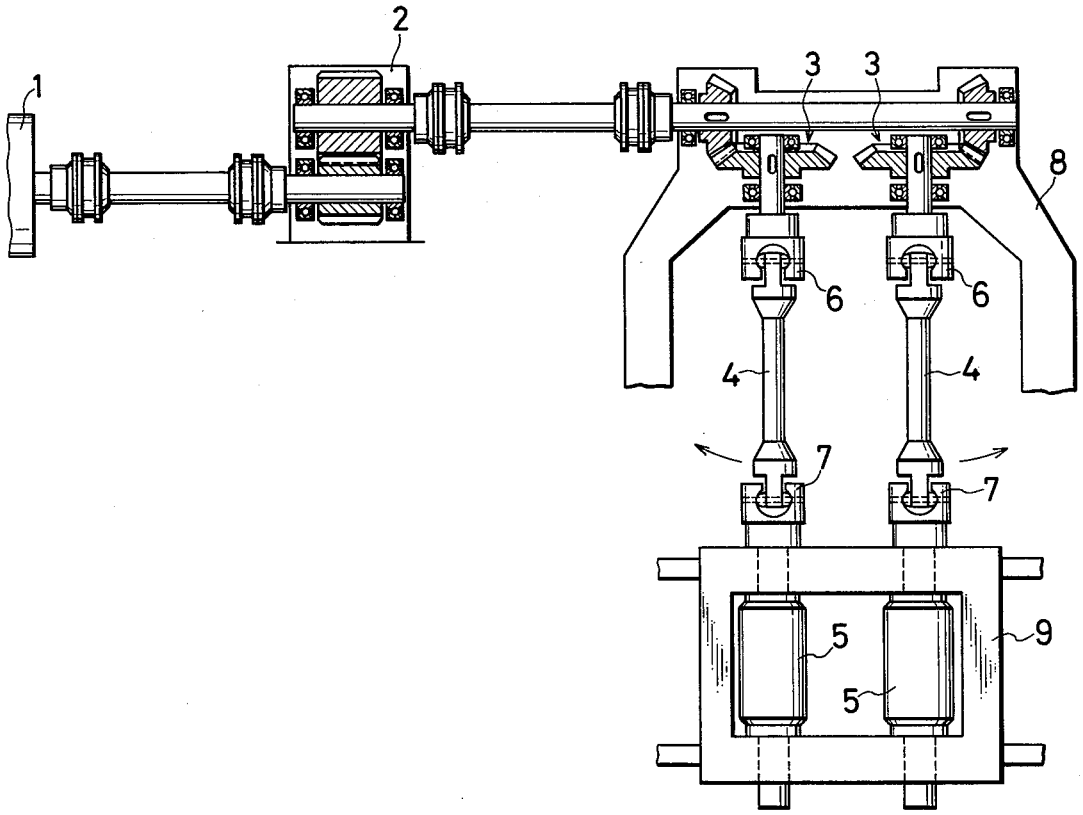
FIG.1 PRIOR ART
FIG. 1 is a front view schematically showing the drive mechanism of a conventional vertical rolling mill.

The fitting yoke 14 is rotatably supported in the unillustrated stand of the vertical rolling mill and is fixedly fitted on and keyed as at **21*a* to a drive shaft element 21 integral with a bevel gear wheel 20 adapted to be driven by a drive unit similar to those shown in FIG. 1, while the coupling 18 has a fitting hole 22 with an oval shape, as is known in the art, and is removably fitted on the roll neck 17** of the same shape.

In the above arrangement, the outer sleeve shaft 12 has a number of hydraulic cylinders 23 fixedly mounted thereon with the piston rods 24 thereof fixed at their front ends to a flange portion 25 formed on the inner shaft 11, thereby providing an extensible operating mechanism, the arrangement being such that feeding hydraulic pressure to said cylinders causes the outer sleeve shaft 12 to be pulled up toward the inner shaft 11, pulling out the coupling 18 from the roll neck 17 or lowering the outer sleeve shaft 12 having been previously pulled up toward the inner shaft 11, thereby fitting the coupling 18 on the roll neck 17.

The outer sleeve shaft 12 has a joint fixing rod 26 fixed at its lower end thereto at the center, said rod 26 being inserted in the hole 27 of the inner shaft 11, and a tension spring 30 is interposed between a flange 28 on said rod 26 and a lower end flange 29 on the inner shaft 11, said spring acting between the outer sleeve shaft 12 and the inner shaft 11 in a direction in which it pulls up the outer sleeve shaft 12, i.e., in a direction in which it reduces the length of the drive shaft section 10.

The length of the joint fixing rod 26 is such that in the extended state of the drive shaft section 10, i.e., in a state where the coupling 18 is fitted on the roll neck 17, the front end 31 of said rod reaches the upper end of the inner shaft 11 and is opposed to a plain hole 33 formed at the center of the cross pin 32 of the universal joint 15. The fitting yoke 14 has fixed thereto a fixing member 35 having a rod fitting and fixing hole 34, said fixing member 35 being opposed to the front end of said rod 26 with said plain hole 33 disposed therebetween. Therefore, when the drive shaft section 10 is reduced in length by the extensible operating mechanism, the front end 31 of the rod 26 is passed through the plain hole 33 at the center of the cross pin 32 and fixedly fitted in the fixing hole 34 of the fixing member 35.

FIG. 2 shows the extended state of the drive shaft section 10, i.e., a state where the coupling 18 has been completely fitted on the roll neck 17. In order to effect roll exchange in this state, the extensible operating mechanism including the hydraulic cylinders 23 is first actuated to pull up the outer sleeve shaft 12 and the coupling 18 is then removed from the roll neck 17. In this operation, the force of the spring 30 interposed between the inner shaft 11 and the outer sleeve shaft 12 assists in pulling up the outer sleeve shaft 12. When the outer sleeve shaft 12 is lifted to the predetermined position, the joint fixing rod 26 integral therewith, passing through the plain hole 33 of the cross pin 32, enters the fixing hole 34 of the fixing member 35 of the fitting yoke 14, thereby fixing the drive shaft section 10 and the upper universal joint 15 and preventing the swing of the coupling 18 and universal joint 19. In this way, roll exchange is effected.

After the roll exchange, the extensible operating mechanism is reversely actuated to fit the coupling 18 on the roll neck 17, with the front end 31 of the joint fixing rod 26 leaving the fixing hole 34 to return to the FIG. 2 state. In this state, since the spring 30 acts in a direction in which it pulls up the coupling 18, the gravity on the drive mechanism is prevented from directly acting on the bearing supporting the roll, thereby reducing the load on said bearing and prolonging the life of the bearing.

As is apparent from the above, the relative position of the inner shaft and outer sleeve shaft may be reversed from what has been shown, and the extensible operating mechanism may use a rack and piniom mechanism or other suitable lifting mechansim, instead of hydraulic cylinders.

We claim:

1. A drive mechanism for vertical rolling mills, comprising:

a drive shaft section comprising an inner shaft and an outer sleeve shaft which are axially slidably fitted together, a universal joint which connects one end of said drive shaft section to the drive side, said universal joint having its fitting yoke fixedly fitted on a drive shaft element, a universal joint which connects the other end of said drive shaft section to the neck of a working roll, said joint having its coupling adapted to be mounted on and dismounted from said roll neck in such a manner as to permit the transmission of torque, an extensible operating mechanism attached between said inner shaft and said outer sleeve shaft, said mechanism being adapted to mount said coupling on and dismount it from the roll neck by extending and collapsing the drive shaft section, a spring contained in the drive shaft section, said spring acting in a direction in which it reduces the length of the drive shaft section, and fixing means provided between said drive shaft section and said drive universal joint for fixing said drive shaft section and said universal joint together when the drive shaft section is reduced in length and for canceling said fixing by the extension of the drive shaft section.

2. A drive mechanism as set forth in claim 1, wherein said extensible mechanism comprises at least a set of hydraulic cylinders and the front ends of the rods of the cylinders fixed to either the inner shaft or the outer sleeve shaft are fixed to the other shaft.

3. A drive mechanism as set forth in claim 1, wherein said fixing means comprises a roddconnected at its base to that one of said inner and outer sleeve shafts which is located below the other and having its front end positioned at the upper end of the drive shaft section when the latter is in its extended state, a plain hole extending through the cross pin of said drive universal joint and positioned above said rod, and a fixing member provided on said fitting yoke and adapted to engage and disengage the front end of said rod, the arrangement being such that when the length of the drive shaft section is reduced, the front end of said rod engages the fixing member to thereby fix the drive shaft section to the universal joint.

4. A drive mechanism as set forth in claim 3, wherein the inner shaft is disposed in the upper region of the drive shaft section and the outer shaft is disposed in the lower region of the drive shaft section, while said spring is carried on said rod and exerts a force acting between a flange on the front end of the rod and a flange on the lower end of the inner shaft in a direction in which it reduces the length of the drive shaft section.

* * * * *